United States Patent [19]

Shull

[11] Patent Number: 4,817,810

[45] Date of Patent: Apr. 4, 1989

[54] COMBINED CONTAINER HOLDER AND OPENER

[76] Inventor: Michael S. Shull, 2570 N. Kentucky Ave., Evansville, Ind. 47711

[21] Appl. No.: 145,293

[22] Filed: Jan. 19, 1988

[51] Int. Cl.[4] ..... A47I 45/00

[52] U.S. Cl. ..... 220/85 H; 220/94 R; 248/146.6; 294/27.1

[58] Field of Search ..... 220/85 H, 94 R, 96; 248/145.6; 294/27.1

[56] References Cited

U.S. PATENT DOCUMENTS

| | | | |
|---|---|---|---|
| 1,464,789 | 8/1923 | Ward | 220/85 H |
| 2,088,387 | 7/1937 | Rice, Jr. et al. | 248/145.6 X |
| 2,784,578 | 3/1957 | Southwick | 248/145.6 X |
| 2,801,743 | 8/1957 | Geen | 220/94 R X |
| 2,813,742 | 11/1957 | Neugebauer | 248/145.6 |
| 3,074,678 | 1/1963 | Mele | 220/85 H X |
| 3,458,164 | 7/1969 | Massey | 248/145.6 |
| 4,120,073 | 10/1978 | Studebaker | 294/27.1 X |
| 4,602,723 | 7/1986 | DeMars | 220/85 H |

*Primary Examiner*—Steven M. Pollard

*Attorney, Agent, or Firm*—Warren D. Flackbert

[57] ABSTRACT

A combined holder and opener characterized by a framework having a container receiving base, a side wall extending upwardly from the base and including arms at least partially surrounding the container, and a handle. The handle has a first portion extending outwardly from the side wall of the framework and a second portion extending downwardly, where the free end of the latter includes a cavity for selectively receiving the pull tab on the top surface of the container. Provision is also made on the inner surface of the second portion of the handle, in the form of a recessed area, for fingertip engagement.

4 Claims, 1 Drawing Sheet

COMBINED CONTAINER HOLDER AND OPENER

As is known, the usage of containers or cans, such as those containing beverages, as a carbonated drink or the like, is widespread; however, the aforesaid containers generally require the use of a pull-up tab for opening and contents pouring. The latter oftentimes presents difficulty for the user, i.e. in the grasping of the tab due to, for example, fingernail length, and, thus, creates an inconvenience problem. Moreover, it is also desirable to have some form of positive holding for the container during use, i.e. to prevent excess cold transfer to the user's hands and/or the unwanted warming of the contained beverage during carrying or whatever.

The present invention overcomes the preceding problems and/or undesirable results by providing a combined container holder and opener. Briefly, the invention includes a framework having a base onto which the container is disposed, with an associated side wall including container encircling arms and a handle extending rearwardly and downwardly from the side wall. The end of the handle includes a cavity into which a conventional container tab is readily insertable, either for bending into a content flowing condition or for complete tab removal. In any event, the cooled container is separated from the user's person, eliminating the possibility of unwanted warming due to hand heat.

A better understanding of the present invention will become more apparent from the following description, taken in conjunction with the accompanying drawing, wherein

Figure 1:
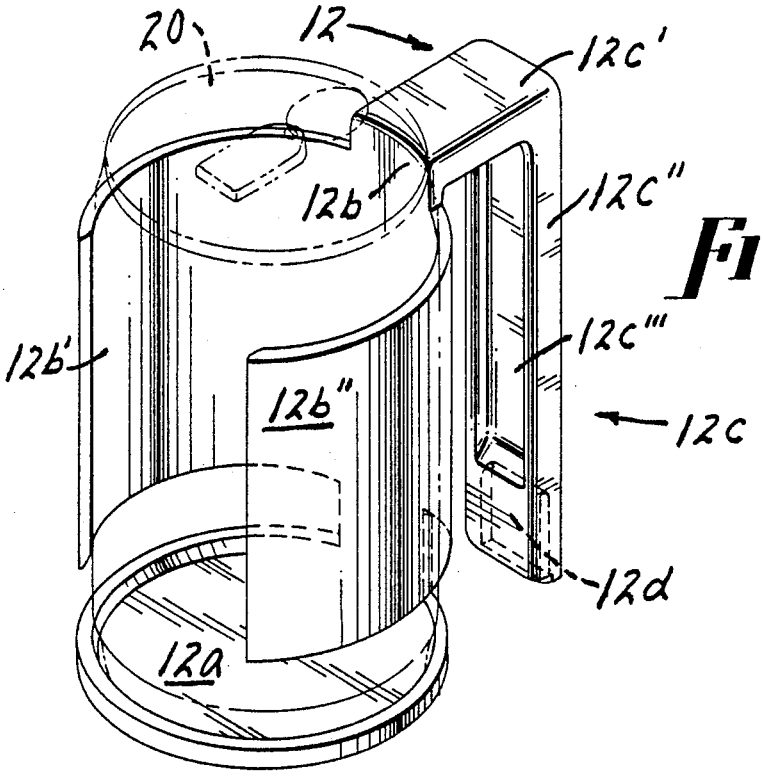
FIG. 1 is a perspective view of a combined container holder and opener in accordance with the teachings of the present invention; and, FIG. 2 is another view in perspective, partly fragmentary and enlarged, showing the invention in typical use as a container opener.

For the purposes of promoting an understanding of the principles of the invention, reference will now be made to the embodiment illustrated in the drawing and specific language will be used to describe the same. It will nevertheless be understood that no limitation of the scope of the invention is thereby intended, such alterations and further modifications of the illustrated device, and such further applications of the principles of the invention as illustrated therein being contemplated as would normally occur to one skilled in the art to which the invention relates.

Referring now to the figures, the combined container holder and opener of the invention is typically defined by a framework 12 having a base or bottom wall 12*a* and an upstanding side wall 12*b*, where the latter includes arm portions 12*b'* and 12*b''* which serve to partially encircle a carried container 20 (shown in phantom in FIG. 1). The arm portions 12*b'* and 12*b''* may present flexible characteristics to further assist in container 20 retaining.

The framework 12 further includes a handle 12*c* having an outwardly extending (from side wall 12*b*) portion

12*c'* and a downwardly extending portion 12*c''*. Portion 12*c''* of the handle 12*c* may include a recessed finger receiving area 12*c'''* on its inner surface, i.e. the surface facing the side wall 12*b* of the framework 12. Receiving area 12*c'''* assists in the holding and opening of the container 20.

Figure 2:
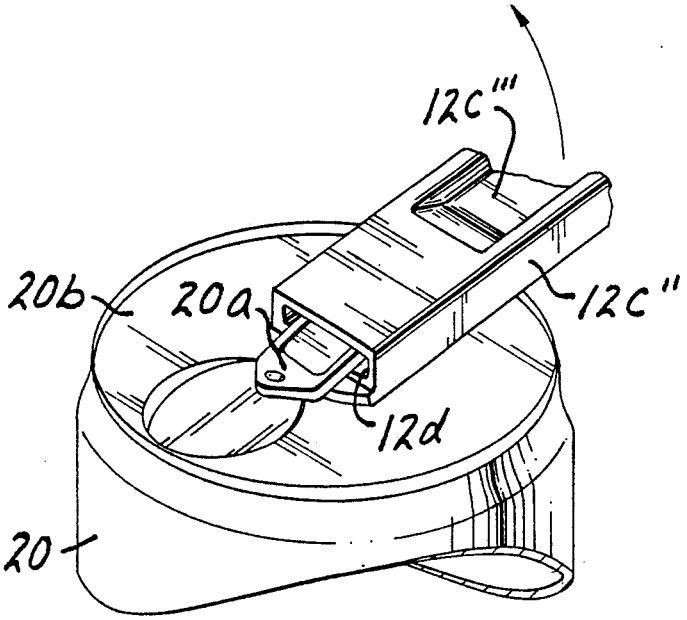

As somewhat evident in FIG. 1, but particularized in FIG. 2, the free end of portion 12*c''* of the handle 12*c* includes a cavity 12*d* adapted to receive a tab 20*a* customarily found on the upper surface 20*b* of container 20. As is known, movement of the tab 20*a* may either serve to reveal the opening to the container by pulling action (see FIG. 1) for complete removal or by rotating the cover operated by the tab 20*a* into the container 20 (where any separation is eliminated).

In any event, with movement of the handle 12*c* in the direction of the arrow in FIG. 2, the container 20 is opened so that the contents thereof can be poured. With the container 20 on the bottom wall 12*a* of framework 12, arm portions 12*b'* and 12*b''* limit any unwanted movement during carrying. In any event, it should be noted that the instant container holder and opener is typically an integral unit, and may be formed from plastic resin material.

It should be evident from the preceding that the invention achieves positive container handling and, as well, effective container entry by simple movement of a tab commonly found on commercially available beverage containers. In other words, everything required for user convenience is immediately available, where, as stated, and after container opening, the opened container 20 is readily placed on the bottom wall 12*a* of the framework 12.

The combined container holder and opener described hereabove is susceptible to various changes within the spirit of the invention including, by way of example, in proportioning; the selection of material used, including the color and/or decoration of such; the precise configuration of the base or bottom wall; and, the like. Thus, the preceding description should be considered illustrative and not as limiting the scope of the following claims.

I claim:

1. A combined holder and opener for a container comprising a framework having a base for supporting the container, a side wall having arm portions at least partially surrounding the outside of said container, and a handle having portions extending outwardly and downwardly from said side wall, said downwardly extending portion having an open cavity at the free end thereof adapted to selectively receive an opening tab for said container.

2. The combined holder and opener of claim 1 where said opening tab for said container is inserted into said open cavity.

3. The combined holder and opener of claim 1 where said downwardly extending portion of said container includes an inwardly facing recessed area for finger placement.

4. The combined holder and opener of claim 1 where said base includes an upwardly directed peripheral rim for positive container placement.

* * * * *